US010895048B2

(12) United States Patent
Gremling

(10) Patent No.: US 10,895,048 B2
(45) **Date of Patent: *Jan. 19, 2021**

(54) SPACER FOR ROAD SAFETY BARRIER

(71) Applicant: ArcelorMittal, Luxembourg (LU)

(72) Inventor: Michaël Gremling, Seraing (BE)

(73) Assignee: ArcelorMittal, Luxembourg (LU)

( * ) Notice: Subject to any disclaimer, the term of this patent is extended or adjusted under 35 U.S.C. 154(b) by 580 days.

This patent is subject to a terminal disclaimer.

(21) Appl. No.: 15/563,457

(22) PCT Filed: Apr. 2, 2015

(86) PCT No.: PCT/IB2015/000440

§ 371 (c)(1),
(2) Date: Sep. 29, 2017

(87) PCT Pub. No.: WO2016/156898

PCT Pub. Date: Oct. 6, 2016

(65) Prior Publication Data

US 2018/0119374 A1 May 3, 2018

(51) Int. Cl.
*E01F 15/04* (2006.01)

(52) U.S. Cl.
CPC ..... *E01F 15/0438* (2013.01); *E01F 15/043* (2013.01)

(58) Field of Classification Search
CPC . E01F 15/0423; E01F 15/043; E01F 15/0438; F16F 7/12; Y10T 403/11
USPC ..... 256/13.1
See application file for complete search history.

(56) References Cited

U.S. PATENT DOCUMENTS 5,044,609 A * 9/1991 Cicinnati ..... E01F 15/04 256/13.1
5,286,137 A * 2/1994 Cicinnati ..... E01F 15/0438 256/13.1
5,657,966 A * 8/1997 Cicinnati ..... E01F 15/0438 256/13.1
5,876,020 A * 3/1999 Giavotto ..... E01F 15/0423 256/1

(Continued)

FOREIGN PATENT DOCUMENTS

AT 409004 5/2002
AT 11255 U1 * 7/2010 ..... E01F 15/0438

(Continued)

*Primary Examiner* — Matthew R McMahon
(74) *Attorney, Agent, or Firm* — Davidson, Davidson & Kappel, LLC

(57) ABSTRACT

A spacer for a road safety barrier is provided. The spacer includes a rail support having a front face to be fastened to a rail, a rear face to be fastened to a post and a flange that connects the front face to the rear face. The front face includes a connector housing and a weaker area connecting the connector housing to the upper edge of the front face, the mechanical resistance of the weaker area being strictly lower than the intrinsic mechanical resistance of the constituent material of the remaining part of the front face of the rail support. The spacer also includes a rail guide including a fastening area for fastening the rail guide to a post above the rail support, a connecting piece and a rail reinforcement area for fastening the rail guide to the reverse side of the rail.

18 Claims, 5 Drawing Sheets

(56) References Cited

U.S. PATENT DOCUMENTS

| | | | | |
|---|---|---|---|---|
| 7,794,173 | B2 * | 9/2010 | Amengual Pericas | E01F 15/0438 256/13.1 |
| 2008/0251776 | A1 * | 10/2008 | Park | E01F 15/0438 256/13.1 |
| 2014/0145132 | A1 | 5/2014 | Leonhardt et al. | |
| 2018/0282957 | A1 * | 10/2018 | Gremling | E01F 15/0438 |

FOREIGN PATENT DOCUMENTS

| | | | | |
|---|---|---|---|---|
| DE | 1534578 | | 9/1969 | |
| DE | 102005004918 | A1 * | 12/2005 | E01F 15/043 |
| EP | 0356686 | | 3/1990 | |
| EP | 0519851 | A1 | 4/1995 | |
| EP | 1762660 | A1 * | 3/2007 | E01F 15/0438 |
| EP | 1780339 | A1 * | 5/2007 | E01F 15/0423 |
| EP | 2180098 | | 4/2010 | |
| EP | 2397610 | | 12/2011 | |

* cited by examiner

SPACER FOR ROAD SAFETY BARRIER

This invention relates to a spacer designed for the construction of road safety devices and more particularly a spacer for a road safety barrier of the type comprising a post and a rail connected to the post via the intermediary of the spacer.

BACKGROUND

It is known that safety barriers can be used along roads to prevent vehicles whose drivers have lost control from leaving the road.

However, the wide variety of vehicles traveling on the roads makes it necessary to resort to safety barriers, the restraining level of which is appropriate to the types of vehicle so that, on the one hand, a car or other lightweight vehicle will not be crushed against a barrier that is too rigid and on the other hand a truck or heavier vehicle does not cross the safety barrier.

In particular, in the event of a collision, the rail must be capable of restraining both a lightweight vehicle, the center of gravity of which is low to the ground, as well as a heavy vehicle, the center of gravity of which is much higher.

EP 0 356 686 describes the use of a safety barrier comprising a spacer that is capable of deforming progressively under the effect of an impact so that the rail rises progressively and thereby restrains a heavy vehicle more effectively. In particular, the rise of the rail is controlled by the rotation of the spacer relative to the post, by the rotation of the rail relative to the spacer and the deformation of the spacer. However, the rise of the rail is of limited amplitude because it is a direct function of the modest dimensions of the spacer and the rail does not rise high enough to effectively restrain a heavy vehicle.

EP 2 180 098 also describes the use of a safety barrier that comprises a spacer in the form of a bent tab fixed to the post at the level of two upside-down V shaped notches. The bolts that connect the spacer to the post are positioned in the throat of the V, in other words in the upper position of the notch. When the vehicle strikes a safety barrier comprising the spacer and begins to bend a post, the spacer is at the same time driven downward by the post and is caused to remain in place by the set of rails of the safety barrier. The effect of these antagonistic forces is to make the bolts connecting the spacer to the post jump out of their notch, thereby releasing the spacer from the post. The rail thus released from the post prevents the vehicle from passing above the rail. However, the complete detachment of the rail from the post makes it impossible to control the subsequent movement of the rail.

SUMMARY OF THE INVENTION

An object of the present invention is to remedy the problems described above by proposing a spacer for a road safety barrier of the type comprising a post and a rail connected to the post via the intermediary of the spacer which is capable of controlling the rise of the rail to restrain both lightweight and heavy vehicles.

For this purpose, the present invention provides a spacer for a road safety barrier of the type comprising a post and a rail connected to the post via the intermediary of the spacer and connector, whereby the spacer comprises a rail support comprising:

- a front face intended to be fastened to a rail,
- a rear face intended to be fastened to a post and
- a flange that connects the front face to the rear face, the front face comprising a connector housing and a weaker area connecting the connector housing to the upper edge of the front face, the mechanical resistance of the weaker area being strictly lower than the intrinsic mechanical resistance of the constituent material of the remaining part of the front face of the rail support, the spacer also comprising a rail guide comprising in succession:

- a fastening area suitable for the fastening of the rail guide to a post above the rail support,
- a connecting piece and
- a rail reinforcement area suitable for the fastening of the rail guide to the reverse side of the rail.

The spacer of the present invention can also have the optional characteristics listed below, considered individually or in combination:

- the rail guide comprises in succession a first vertical branch that functions as a fastening area, the connecting piece and a second vertical branch that functions as a rail reinforcement area,
- the first vertical branch is oriented downward from the connecting piece,
- the connecting piece is horizontal,
- the rail reinforcement area at least partly covers the front face of the rail support,
- the rail reinforcement area comprises a first and a second rail fastening area, whereby the second rail fastening area also constitutes a fastening area to the rail support at the level of the connector housing, so that the rail, the rail guide and the rail support can be connected by a single connector,
- the rail guide further comprises an extension located in the elongated portion of the rail reinforcement area and capable of extending underneath the rail support,
- the connector housing is a circular hole,
- the weaker area comprises a notch that is an extension of the connector housing and emerges on the upper edge of the front face, whereby the two lateral edges of the notch are separated, at least locally, by a distance that is less than the diameter of the connector,
- the weaker area comprises a succession of holes that are essentially aligned along the longitudinal direction of the rail support, and
- the weaker area comprises a throat that is an extension of the connector housing and emerges on the upper edge of the front face.

The present invention also provides a safety barrier comprising a post and a rail connected to the post via the intermediary of a spacer claimed by the invention.

The present invention further provides a fabrication kit for a safety barrier comprising a post, a rail, a connector and a spacer as claimed by the invention, whereby the spacer is capable of fastening the rail to the post by means of the connector.

Other characteristics and advantages of the invention will be described in greater detail in the following description.

BRIEF DESCRIPTION OF THE DRAWINGS

The invention will be better understood by reading the following description, which is provided purely for purposes of explanation and is in no way intended to be restrictive, with reference to the attached figures, in which.

DETAILED DESCRIPTION

The same reference numbers represent the same elements in each of the figures.

It should be noted that the terms "top", "bottom", "front", "rear", "above", "below", "upper", "lower", as used in this application refer to the orientation of the different constituent elements of the road safety barrier when they are installed along the roadway.

Throughout the text, bolts will be used as the connector for purposes of simplification. It is possible, however, to provide other connectors to connect the different constituent elements of the road safety barrier to one another. A person skilled in the art will be familiar with the different connectors that are suitable for each case and will use them as a function of his specific requirements.

Throughout the text, a tab means an element that has a thin, narrow and elongated shape. The tab can be in the form of a plate or a sheet consisting of a single material or a composite assembly. In this latter case, the tab is a superposition of a plurality of layers of the same material or of different materials. The material in question can be, among other things, a metal material or a polymer. By way of non-restricting examples, the metal materials can be steel, aluminum, copper or zinc. The tab is preferably a metal sheet. The tab is preferably steel, previously galvanized to protect it against corrosion.

In the framework of the invention, the tab will have been previously formed by means of any known forming process, among which can be cited by way of non-restricting examples bending, profiling, stamping, and die casting.

Figure 1:
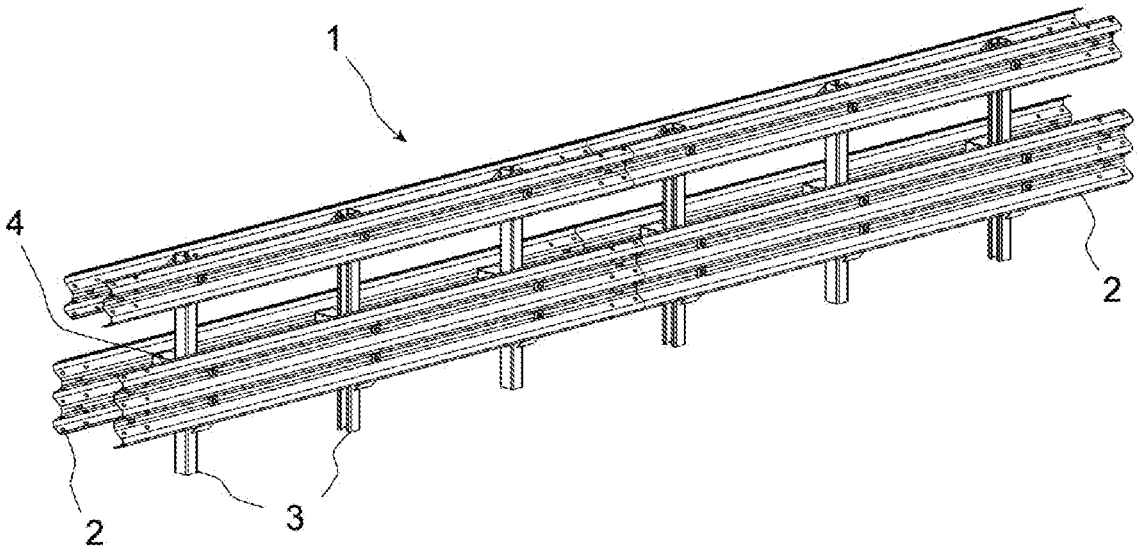
FIG. 1 is a view in perspective of a safety guardrail comprising a spacer as in a variant of the invention.
Figure 2:
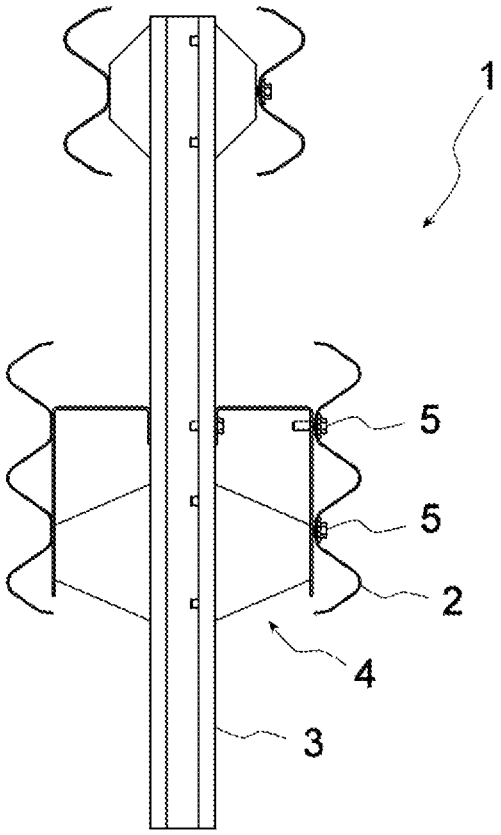
FIG. 2 is a sectional view of a safety guardrail comprising a spacer as in a variant of the invention.

With reference to FIGS. 1 and 2, a road safety barrier 1 comprises a plurality of posts and rails, whereby a given rail 2 is connected to a given post 3 via the intermediary of the spacer 4 and bolts 5.

In the framework of the invention, the shape of the posts and of the rails is not limiting. The posts are generally structural shapes, the cross section of which can be open and be in the shape of a C, a U, an H, a T, a sigma or a Z. Alternatively, the cross section can be closed and can have a round or rectangular or even polygonal shape. The rails are generally very long structural shapes, the cross section of which can be in the shape of a double corrugation, a triple corrugation, a C or even a sigma.

Figure 3:
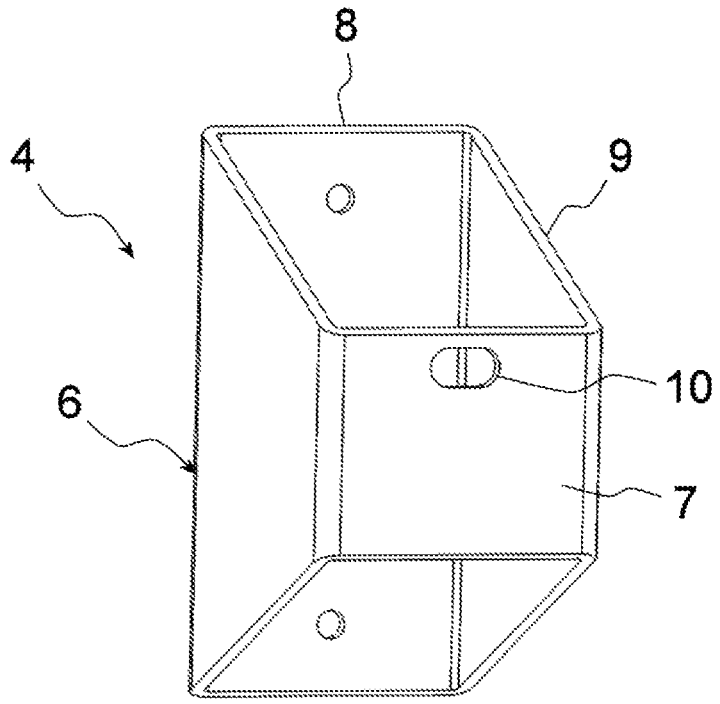
FIG. 3 is a view in perspective of a rail support as in a variant of the invention, FIGS. 4 *a*), 4 *b*) and 4 *c*) show a view in perspective of the portion of a rail support comprising a connector passage as in a first variant of the invention.

With reference to FIG. 3, the spacer 4 first comprises a rail support 6 comprising a front face 7 designed to be fastened to a rail, a rear face 8 designed to be fastened to a post and a flange 9 connecting the rear face to the front face.

In a preferred embodiment, the flange 9 is flat and forms a right angle with the front face on the one hand and with the rear face on the other hand. The geometry of the shape of the flange 9, however, can have other shapes, such as, by way of nonrestrictive examples, a circular arc or undulations, etc.

In a preferred embodiment, the flange connects the lateral edges of the front and rear faces of the rail support. However, the flange can alternatively connect the bottom edges of the front and rear faces.

A technician skilled in the art will be able to adapt the geometry, the shape and the position of the flange 9 of the rail support to give it the desired level of restraint and deformability, as a function of local regulatory requirements.

In one preferred embodiment of the invention, the rail support is a tube with a vertical axis. Depending on the desired strength of the tube, its cross section can have different geometries, such as a polygonal, rectangular, square or even essentially circular cross section. Preferably, the cross section of the tube is rectangular or square so that the tube can more easily bend in the event of an impact and thereby absorb a greater quantity of energy. Moreover, the symmetry of the tube enables the rail support to exhibit the same behavior whether the impact comes from the left or from the right. It is therefore possible to use a single geometry of rail support so that the road safety barrier can be used to protect the left edge or the right edge of the road; this capability facilitates the installation of such a barrier.

The rail support comprises a lower end and an upper end. In particular, the lower end is formed by the bottom edge of the front face 7 and the bottom edge of the rear face 8. Likewise, the upper end is formed by the upper edge of the front face 7 and the upper edge of the rear face 8.

Preferably, the lower and/or upper ends are beveled so that, in the event of an impact, the rail is not torn on the cutting edges of the ends of the rail support. Consequently, the bevel is executed so that the rear face of the rail support is higher than its front face. More specifically, in the case of a beveled upper end, the upper edge of the rear face 8 of the rail support is in a plane that is located above the plane of the upper edge of the front face 7 of the rail support. In the case of a beveled lower end, the bottom edge of the rear face of the rail support is in a plane located below the plane of the bottom edge of the front face of the rail support. The bevels also facilitate the fastening of the spacer to the post of the safety barrier at the level of holes, which are suitable for the passage of bolts, which are preferably located in the upper and/or lower part of the rear face of the rail support.

Preferably, the rail support 6 is made of steel, and more preferably of steel that has an elastic limit between 235 and 500 MPa. In particular, the mechanical characteristics of the steel will be selected from those specified in the pertinent European and US standards, such as, including but not limited to, standards EN10025-2, EN10149, EN10346, ASTM A 1011 and ASTM A 500. Preferably, the rail support 6 has a thickness between 3 and 8 mm to make the optimum operation of the invention possible. A thickness that is too low can present risks of local instability, while a thickness that is too great risks resulting in a rail support that is too strong.

A person skilled in the art will be able to adapt the shape of the rail support, the intrinsic mechanical characteristics of the material and the thickness of the rail support to give the spacer the desired level of restraint and deformability, as a function of local regulatory requirements.

With reference to FIGS. 3 to 6, the front face 7 of the rail support 6 also comprises a connector passage 10 located in the upper portion of the front face. This connector passage itself comprises a connector housing 11 and a weaker area 12 connecting the connector housing 11 to the upper edge of the front face 7.

The function of the connector housing 11 is to allow the insertion and holding in place of a connector that provides a connection between the rail and the rail support. For this purpose, its dimensions and its geometry are adapted to the dimensions of the connector, while taking into consideration the clearances necessary for assembly.

Preferably, the connector housing 11 is a hole that is at least partly circular. In this case, the diameter of the hole is adapted to the diameter of the connector that provides the connection between the rail and the rail support. In particular, the diameter of the hole is essentially equal to or preferably slightly larger than the diameter of the connector. More preferably, the diameter of the hole is 1.01 to 1.25 times larger than the diameter of the connector. It goes without saying that the diameter of the connector in question is its diameter in a plumb line with the connector housing. Therefore, in the case of a bolt, the diameter in question is the diameter of the threaded shaft.

In one embodiment, the connector housing 11 is a circular hole which diameter is 1.01 to 1.25 times larger than the diameter of the bolt. The rail, the rail support and the bolt can therefore be assembled with a good fit. Moreover, in the event of an accidental loosening of the bolt, the rail nevertheless remains properly held in place.

The weaker area 12 is defined by its width which is equal to the width of the connector housing 11 and by its length which is equal to the distance between the connector housing 11 and the upper edge of the front face 7.

The function of the weaker area 12 is to release the connector when it is subjected to a minimum upward force. For this purpose, the mechanical resistance of the weaker area is strictly lower than the intrinsic mechanical resistance of the constituent material of the remaining part of the front face of the rail support. In particular, its geometry is adapted to allow the connector to rise to the top edge of the front face in the event of the application of an upward force.

In one embodiment of the invention illustrated in FIG. 3, the weaker area 12 is a tab made of very narrow material. In other words, the connector housing 11 is located in the immediate vicinity of the top edge of the front face. More preferably, the width of the tab is between 1 and 5 mm. In the case of an upward force exerted on the bolt, the threaded shaft of the bolt tears this tab and the bolt is thereby released.

Figure 4A:
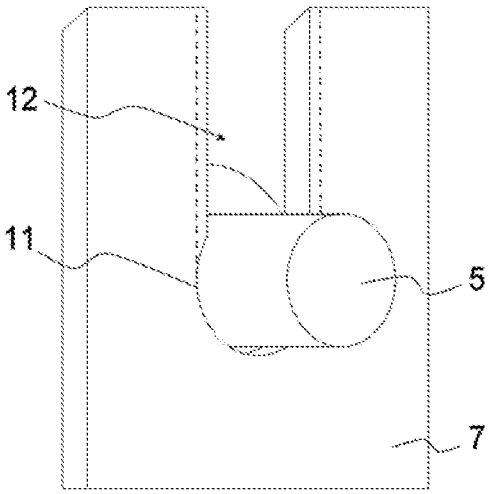
Figure 4B:
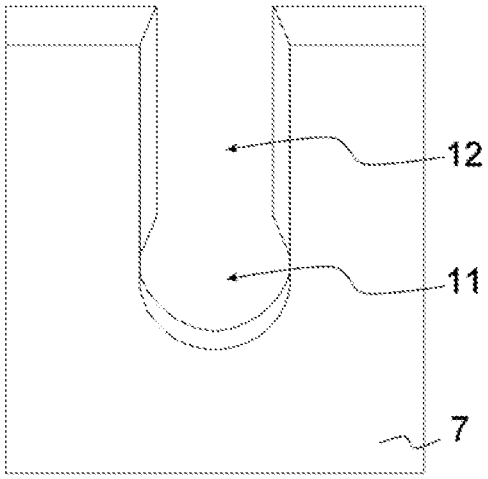
Figure 4C:
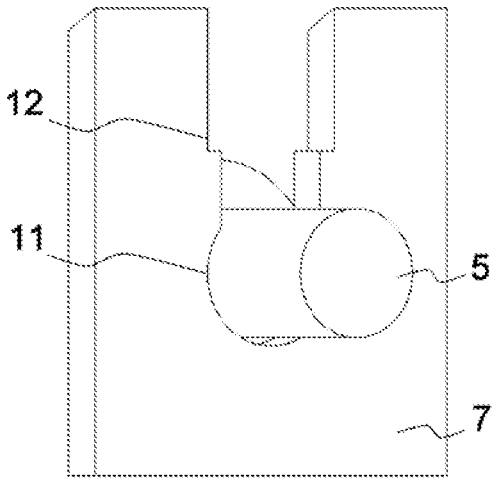

In one embodiment of the invention illustrated in FIG. 4, the weaker area 12 consists of a notch that is an extension of the connector housing and emerges on the upper edge of the front face 7. The two lateral edges of the notch are separated at least locally by a distance which is less than the diameter of the bolt. In other words, the notch includes a pinched portion. The bolt can therefore rise along this notch only if the threaded shaft of the bolt forces its way through at the level of the pinched portion.

Figure 5:
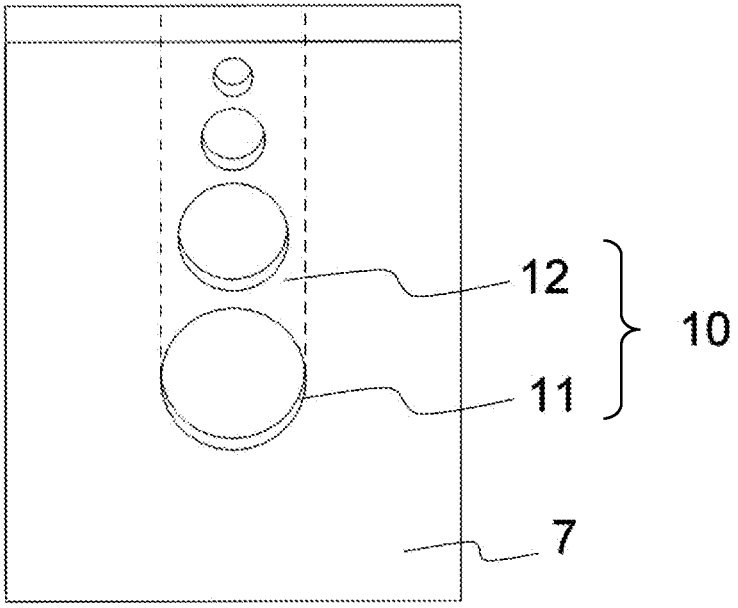
FIG. 5 is a view in perspective of the portion of a rail support comprising a connector passage as in a second variant of the invention.

The pinched portion can have the following shapes, which are cited as nonrestrictive examples:

- the lateral edges of the notch are parallel and separated by a distance which is strictly less than the diameter of the threaded shaft of the bolt 5, as illustrated in FIG. 4 *a*),
- the lateral edges of the notch are parallel and beveled so that the distance separating them from one side of the front face of the rail support is strictly less, on the one hand, than the diameter of the threaded shaft of the bolt, and on the other hand, than the distance separating them from the other side of the front face of the rail support, as illustrated in FIG. 4 *b*),
- the lateral edges of the notch are separated by a distance that is strictly less than the diameter of the threaded shaft of the bolt 5 in the vicinity of the connector housing 11, then by a distance that is greater than the diameter of the threaded shaft of the bolt in the vicinity of the top edge of the front face, as illustrated in FIG. 4 *c*), In one embodiment of the invention illustrated in FIG. 5, the weaker area 12 comprises a succession of holes that are essentially aligned along the longitudinal direction of the rail support. In the case of an upward force exerted on the bolt, the threaded shaft of the bolt tears the material between two consecutive holes and thereby rises notch by notch. Depending on the desired disconnection profile, the holes can have a constant diameter or can have a decreasing diameter from the connector housing toward the upper edge of the front face.

Figure 6:
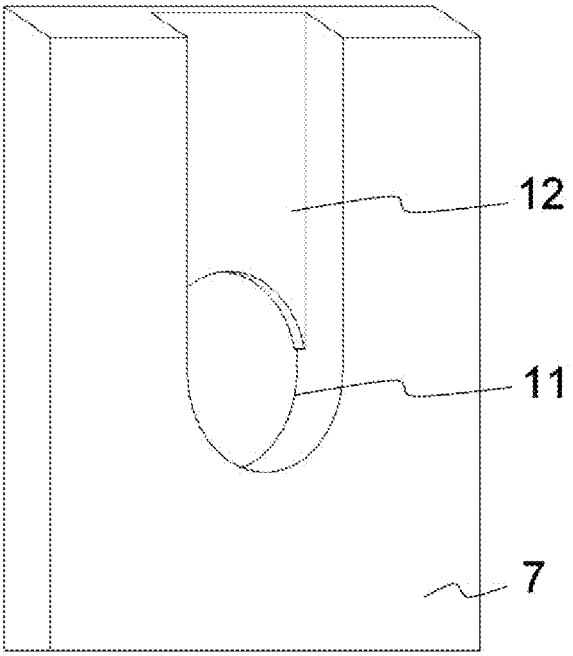
FIG. 6 is a view in perspective of the portion of a rail support comprising a connector passage as in a third variant of the invention.

In one embodiment of the invention illustrated in FIG. 6, the weaker area 12 comprises a throat that is an extension of the connector housing 11 and emerges on the upper edge of the front face. In other words, the front face of the rail support has a reduced thickness in the weaker area. The bolt can therefore rise along this throat only if the threaded shaft tears the remaining material at the level of the throat.

In another embodiment of the invention, the weaker area 12 does not comprise any hole, notch or throat. In that case, the lower mechanical resistance of the weaker area 12 has simply been obtained by heat treating the constituent material of the weaker area.

A person skilled in the art will be able to adapt the geometry and the mechanical resistance of the weaker area 12 so that the rail is released from the rail support for an upward force in the range between the force exerted by a lightweight vehicle and the force exerted by a heavy vehicle. Therefore, in the event of an impact by a lightweight vehicle, the rail remains in place and effectively restrains the vehicle. Likewise, in the event of an impact by a heavy vehicle, the rail rises and thereby ensures the effective retention of the vehicle.

The connector passage 10 can be created by any method known to a person skilled in the art such as, by way of nonrestrictive examples, punching, milling, mechanical cutting, laser cutting, water jet or oxyacetylene cutting.

Figure 7:
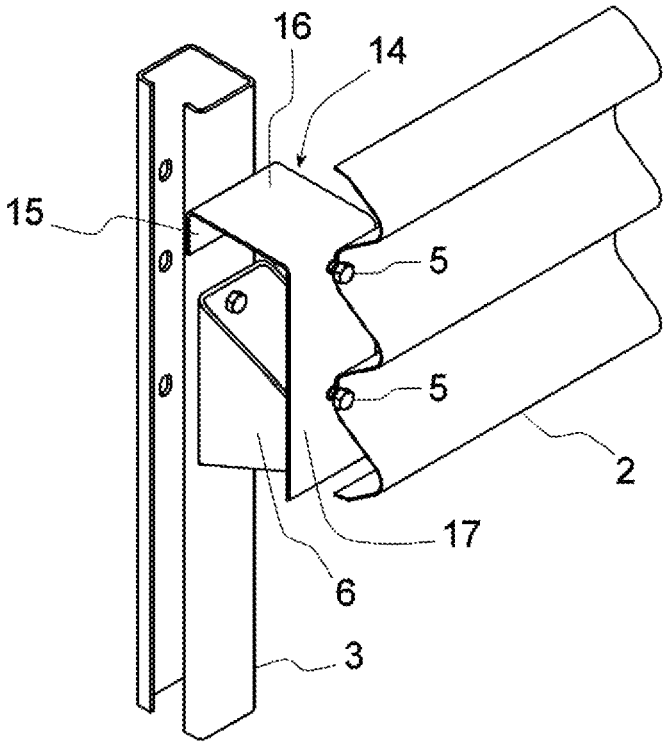
FIG. 7 is a view in perspective of a spacer as in a variant of the invention.

The spacer 4 also comprises a rail guide 14 located between the post 3 and the rail 2, above the rail support 6, as illustrated in FIG. 7. The rail guide makes it possible for the rail to rise in a controlled manner after the release of the bolt 5 via the connector passage 10. In particular, the function of the rail guide is to control the upward movement of the rail after its detachment from the rail support, to more effectively contain heavy vehicles by making the rail rise, for example to the level of the vehicle axles, while preventing the rail from rising too far, for example above the vehicle axles. An excessive rise of the rail would allow the vehicle wheels to reach the posts of the safety barrier and thus to damage the latter.

To ensure this function, the rail guide 14 comprises in succession a fastening area 15 suitable for the fastening of the rail guide to a post above a rail support, a connecting piece 16 and a rail reinforcement area 17 suitable for the fastening of the rail guide on the reverse side of the rail.

Therefore, in the event of an impact that causes the disconnection of the rail from the rail support, the connecting piece 16 is inclined toward the post under the pressure of the vehicle. Consequently, the rail is driven upward within the limits set by the dimensions of the rail guide.

Figure 8:
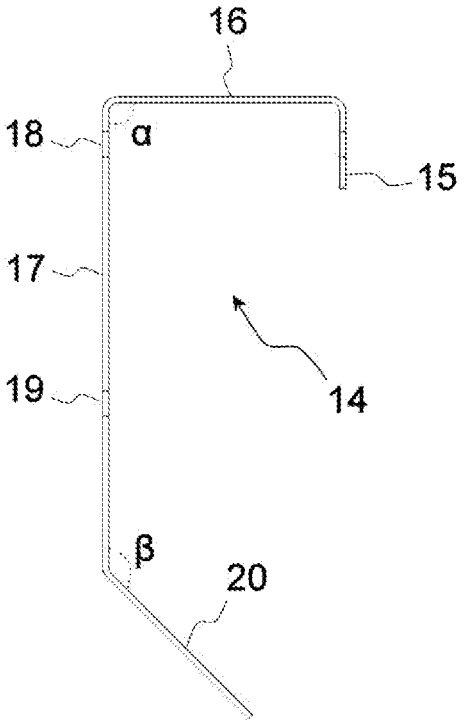
FIG. 8 is a longitudinal section of a rail guide as in one variant of the invention.

In one embodiment illustrated in FIG. 8, the rail guide is in the shape of a tab comprising in succession a first vertical branch that serves as a fastening area 15 and is designed to be fastened to the post, a connecting piece 16 and a second vertical branch that acts as a rail reinforcement area 17 and is designed to be fastened to the reverse side of the rail.

The first vertical branch 15 makes it possible to fasten the tab to the post above the rail support. The first vertical branch 15 is therefore preferably perforated with a hole for the passage of a bolt. It is preferably oriented downward from the connecting piece 16. Therefore, in the event of an impact that results in the disconnection of the rail from the rail support, the tab is easily unfolded at the intersection of the first vertical branch and the connecting piece, thereby more easily driving the rail upward.

The first vertical branch 15 is extended by a connecting piece 16 that extends forward. Its length is adapted so that the forward end of the connecting piece is located approximately in the plane of the front face of the rail support when the first vertical branch is fastened to a post. The connecting piece is preferably horizontal to minimize the quantity of material necessary to reach the plane of the front face of the rail support. In one embodiment, it is inclined so that the angle $\alpha$ between the connecting piece and the second vertical branch is less than 90°. In the event of an impact that results in the disconnection of the rail from the rail support, this configuration facilitates the bending of the tab at the intersection of the connecting piece and the second vertical branch and thus the rise of the tab and of the rail that is connected to it.

The connecting piece 16 is extended downward by a second vertical branch 17. In the illustrated embodiment, the second vertical branch 17 comprises a rail fastening area 18 located in the upper portion of the second vertical branch.

Preferably, the second vertical branch at least partly covers the front face 7 of the rail support 6. It can thereby be inserted between the rail support 6 and the rail 2. The rail guide therefore constitutes a shield between the rail and the rail support, so that the rail is less damaged, in the event of an impact, by the single point represented by the rail support. In the embodiment illustrated in FIG. 8, the second vertical branch 17 therefore has a length such that the second vertical branch can be inserted between the rail support 6 and the rail 2. The second vertical branch 17 increases the rigidity of the rear portion of the rail and thereby prevents it from becoming embedded in the rail support in the event of an impact, which would locally reduce the restraining level of the rail.

Preferably, the second vertical branch 17 also comprises a second rail fastening area 19 located in the lower portion of the second vertical branch so that the rail is fastened in two points and is therefore more effectively held in position. Preferably, the second rail fastening area 19 also constitutes a fastening area to the rail support 6 at the level of the connector housing 11, such that the rail 2, the rail guide 14 and the rail support 6 can be connected by a single bolt. In other words, the rail reinforcement area 17 of the rail guide 14 can be fastened to the connector housing 11 of the rail support 6.

Preferably, the second vertical branch 17 extends downward farther than the lower end of the rail support, in particular lower than the lower edge of the front face 7 of the rail support, so that the rail guide constitutes a shield between the rail and the rail support over the full height of the rail support.

The rail guide preferably also comprises an extension 20 which is located in the elongated portion of the rail reinforcement area 17 and which extends underneath the rail support. For this purpose, the angle $\beta$ between the rail reinforcement area 17 and the elongation 20 is less than 180°, preferably in the range between 120 and 150°. This elongation further improves the rise of the rail along the rail support, after the disconnection of the rail from the rail support, by preventing the rail from tearing on the cutting edges of the lower end of the rail support.

A person skilled in the art will be able to adapt the dimensions and geometry of the rail guide so that the guide rises in the desired proportions after its disconnection from the rail support and also so that the rail is at the desired level to effectively restrain a heavy vehicle. In particular, a person skilled in the art will be able to adapt the respective dimensions and geometries of the constituent elements of the rail guide relative to the dimensions and geometry of the rail support such that the rail rises in the desired proportions after its disconnection from the rail support and thus so that the rail is at the desired level to ensure the effective restraint of a heavy vehicle.

By way of example, in the case illustrated in FIG. 7, the rail support 6 and the rail guide 14 have the following dimensions:

- height of the rear face 8 of the rail support: 25.4 cm,
- height of the front face 7 of the rail support: 10.16 cm
- width of the front and rear faces of the rail supports: 13.33 cm
- width of the flange 9 of the rail support: 18.44 cm
- angle $\alpha$: 90°
- height of the first vertical branch 15 of the rail guide: 6.86 cm
- length of the connecting piece 16 of the rail guide: 18.9 cm
- length of the second vertical branch 17 of the rail guide: 35.1 cm
- angle between the second vertical branch and the elongation: 135°
- length of the extension 20 of the rail guide: 15 cm
- width of the rail guide: 15.24 cm
- distance separating the upper edge of the rear face 8 of the rail support from the lower edge of the first vertical branch 15 of the rail guide: 6.54 cm Computer simulations performed on safety barriers comprising a spacer as claimed by the invention have confirmed the good behavior of the barrier in the event of an impact with a heavy vehicle and in particular the proper rise of the rail after the disconnection of the rail from the rail support.

The invention has been described in the case of the integration of a spacer into a road safety barrier. However, the spacer claimed by the invention is naturally not limited to this single utilization. It is easy to visualize potential utilizations for other types of road safety equipment.

What is claimed is:

1. A spacer for a road safety barrier, the road safety barrier having a post and a rail connected to the post via an intermediary of the spacer and a connector, the spacer comprising:

a rail support comprising:

a front face designed to be fastened to the rail, the front face comprising a connector housing and a weaker area connecting the connector housing to an upper edge of the front face, a mechanical resistance of the weaker area being strictly lower than an intrinsic mechanical resistance of a constituent material of a remaining part of the front face of the rail support;

a rear face designed to be fastened to the post; and a flange connecting the front face to the rear face; and a rail guide comprising in succession:

a fastening area suitable for fastening the rail guide to the post above the rail support;

a connecting piece; and a rail reinforcement area suitable for fastening the rail guide to a reverse side of the rail to be fastened to the rail support.

2. The spacer as recited in claim 1, wherein the fastening area includes a first vertical branch and the rail reinforcement area includes a second vertical branch.

3. The spacer as recited in claim 2, wherein the first vertical branch is oriented downward from the connecting piece.

4. The spacer as recited in claim 2, wherein the connecting piece is horizontal.

5. The spacer as recited in claim 2 wherein a surface of the rail reinforcement area at least partly covers with direct contact the front face of the rail support.

6. The spacer as recited in claim 1, wherein the rail reinforcement area at least partly covers the front face of the rail support.

7. The spacer as recited in claim 1, wherein the rail reinforcement area includes a first and a second rail fastening area, the second rail fastening area also includes a fastening area to the rail support at the level of the connector housing, such that the rail, the rail guide and the rail support can be connected by a single connector.

8. The spacer as recited in claim 1, wherein the rail guide includes an extension, located in an elongated portion of the rail reinforcement area and capable of extending underneath the rail support.

9. The spacer as recited in claim 1, wherein the connector housing is a circular hole.

10. The spacer as recited in claim 1, wherein the weaker area includes a notch that is an extension of the connector housing and emerges on the upper edge of the front face, whereby two lateral edges of the notch are at a distance from each other, at least locally, that is less than a diameter of the connector.

11. The spacer as recited in claim 1, wherein the weaker area includes a succession of holes that are aligned along the longitudinal direction of the rail support.

12. The spacer as recited in claim 1, wherein the weaker area includes a throat that is an extension of the connector housing and emerges on the upper edge of the front face.

13. A road safety barrier comprising:

the spacer as recited in claim 1;

the post; and the rail, the rail and the post being connected via the intermediary of the spacer.

14. The road safety barrier as recited in claim 13 further comprising a second rail attached to the post above the rail.

15. The road safety barrier as recited in claim 13 further comprising a connector connecting the rail to the rail support and the rail guide.

16. The road safety barrier as recited in claim 15 wherein the connector is a bolt.

17. The road safety barrier as recited in claim 13 wherein at least part of the rail reinforcement area is located between the rail and the rail support.

18. A fabrication kit for a safety barrier comprising:

the spacer as recited in claim 1;

the post;

the rail; and the connector;

the spacer being capable of fastening the rail to the post via the connector.

* * * * *